US005655622A

United States Patent [19]

Pavlu

[11] Patent Number: 5,655,622

[45] Date of Patent: Aug. 12, 1997

[54] WIRE CADDY ATTACHABLE TO A LADDER

[76] Inventor: Stephen Pavlu, 66 Hempstead Ave., Staten Island, N.Y. 10306

[21] Appl. No.: 546,532

[22] Filed: Oct. 20, 1995

[51] Int. Cl.[6] ..... E06C 7/14; B65H 49/38

[52] U.S. Cl. ..... 182/129; 242/129.6; 242/594.5

[58] Field of Search ..... 182/129; 248/210; 242/594.4, 594.5, 129.6, 129.62

[56] References Cited

U.S. PATENT DOCUMENTS 3,771,743 11/1973 De Luca et al. ..... 242/129.8

4,533,091 8/1985 Knight et al. ..... 182/129

4,869,344 9/1989 Petersen ..... 182/129

*Primary Examiner*—Leslie A. Braun

*Assistant Examiner*—Donald J. Wallace

[57] ABSTRACT

The present invention relates to a wire spool holder that is integrally mounted upon a standard ladder. The cross members that hold the wire spool are adjustably mounted such that different size wire spools can be accommodated. In addition the present invention allows the ladder having the wire caddy mounted thereon to both be fully collapsed into a compact configuration.

9 Claims, 5 Drawing Sheets

WIRE CADDY ATTACHABLE TO A LADDER

BACKGROUND OF THE INVENTION

1. Field of the Invention

The present invention relates to a wire caddy. More particularly, the present invention relates to wire caddy attachable to a ladder capable of holding spools of wire utilized in the electrical trade.

2. Description of the Prior Art

In wiring, it is common to thread coded wires through conduit to install desired circuits. In such cases the various colored wire is supplied in individual spools, which must be taken to the immediate work area where wire is pulled from one or more spools as needed and threaded through the conduit. The electrician usually works from a step ladder and is required to manipulate the wire. Also when the ladder is moved, the spools, which must also be moved, get in the way and or the wires get tangled.

Efforts have been made to overcome the foregoing problem, but so far, no device has proven satisfactory for the types of wires and work under consideration. Prior art devices describe clamps on a fixed stud and presents a horizontal table with a vertical shaft about which a coil may be placed. The coil is supported on the table and rotates therewith as the wire is unwound. The device cannot be used with a plurality of spools because they would interfere with each other. Also, the device is designed for use with vertical standing studs and is only useful if they are available.

Numerous innovations for wire caddies have been provided in the prior art that are described as follows. Even though these innovations may be suitable for the specific individual purposes to which they address, they differ from the present invention as hereinafter contrasted.

In U.S. Pat. No. 4,533,091, Titled, PORTABLE MULTIPLE SPOOL WIRE DISPENSER, invented by Knight et al., A wire dispensing device having two brackets adapted to mount on spaced apart step ladder support legs and a spool holding shaft spanning the distance between brackets and secured thereto. The shaft is so mounted to the brackets that one end can be swung out for adding or removing spools.

The present invention differs from the above described patent due to the different type of mounting devices. The present invention's wire caddy is fully retractable within the ladder upon collapsing whereas the patented invention must be removed prior to collapsing due to the external bracket members.

In U.S. Pat. No. 3,771,743, Titled, WIRE SPOOLS HOLDING AND DISPENSING APPARATUS, Invented by, De Luca et al., A wire holding and dispensing apparatus comprises a frame having a plurality of transverse divider members and a median member secured to said transverse divider members and disposed laterally with respect to said frame thereby forming a plurality of compartments. A stub-shaft is fixedly mounted on each side of the median member within each of the compartments. Each of the stub-shafts is disposed in coaxial alignment with another stub-shaft which is fixedly mounted against undesired rotational movement and secured to the frame, while the other stub-shaft is capable of axial movement. A wire spool is disposed between coaxial pairs of the stub-shafts with the axially movable stub shaft exerting a frictional force on the ends of the wire spool to retard reverse rotational movement thereof, and wire guide members are secured to the frame associated with each of the wire spools with the ends of the wire extending through the guide members to locate the ends at a predetermined position with respect to the frame.

The present invention differs significantly from the patented invention due to the adjustable feature where the wire spool is adjustably mounted upon a tracking system rather than the patented invention which mounts through the rung supports which weakens the entire structure.

Numerous innovations for wire caddies have been provided in the prior art that are adapted to be used. Even though these innovations may be suitable for the specific individual purposes to which they address, they would not be suitable for the purposes of the present invention as heretofore described.

SUMMARY OF THE INVENTION

In many wiring applications a plurality of wires of various gauge, number of conductors and colors must be employed in completing a wiring application. In these wiring applications, which are repetitive, there are employed a plurality of wire spools which comprise various types of reels of wire wound upon the spool or bobbin. When a length of wire is purled from the reel and cut therefrom, the red has a memory which tends to cause the wire to become rewound and makes it difficult to locate the end of the reel upon the net wiring application. This presents a frustrating situation to the workman performing three or multiple wiring applications. In addition, it requires consummation of an inordinate mount of time which is unproductive to continuously locate the ends of the wire reels. Moreover, in many wiring applications such as those which are existent in central telephone offices, it is necessary to repeat the applications over a substantial area which is both vertically and horizontally extensive.

The foregoing and probably other objects are achieved by a structure that comprises brackets each adapted to fit on the generally spaced apart rungs of a ladder having at least one wire spool holder therebetween. It is important that the wire spool holder be generally horizontal and that the several spools be free to rotate independently to insure maximum flexibility of use.

The present invention does not concern itself with the intricate stub shaft and frictional engagements of wire spools. The present invention just supports horizontal bars adjustable and designed to hold spools of #10 through 18 building construction wire and wire reels of manufactured cable. The present invention differs entirely from the inventions as noted above.

The major differences between the present invention and the prior art is the present invention has a frame mounted on a existing ladder, with no holds drilled into the ladder (weakens ladder) no fasting devices secured into the wood of the ladder.

The present invention describes frame mounts on the top rung of a ladder which is usually six feet in height and is secured with spring loaded hinges to the bottom rung. The frame hangs within the ladder itself, and wire is supported in the center. The frame folds up with the ladder and actually becomes part of the ladder when not in use.

The frame has adjustable rung supports to accommodate spools of electrical wire in various colors and sizes up to 18" in diameter such as:

A. 500' spools approx. 5" diameter

B. 1000' spools of multi conductor BX or Romex wire. Approximately 17" Diameter spools.

C. 1000' spools of fire alarm cable. Approximately 17–18" Diameter spools.

D. Any combination thereof.

E. Telephone spools of wire or computer cables. Approximately 18" diameter.

F. Up to 9 500" spools of wire can be installed.

The present invention Wire Caddie Ladder is designed to be mounted on any wooden 6 or 8' ladder as a kit, which means a user can use it on existing ladder inventory. It can also be manufactured with the mounting brackets integral with the ladder legs and now becomes a permanent part of the new ladder.

The present invention describes a new ladder with fixed side supports to hold adjustable wire brackets which is installed on the side rails of the ladder.

A. Relocated top wood rung.

B. Fixed bottom wood rung.

The present invention eliminates 3 wood rungs in the middle of the ladder and uses wire supports (horizontal) and adjustable brackets to hold wire spools as described with adjustable side brackets to hold wire between the top and bottom rung. A wide range of wire spool sizes and types can be used in multiples and is part of the ladder and always available. Can be used as a ladder with or without wire installed on it.

Presently ladders used in the electric industry are of the industrial type and rated for up to 350 lbs. They have 5 rungs on the leg support. The present invention is designed in various ways to pull wire through the rungs of the ladder or through the steps of the ladder. For greater support.

The types of problems encountered in the prior art are weakening of the ladder to attach the wire caddy and non adjustability of the wire caddy.

In the prior art, unsuccessful attempts to solve this problem were attempted namely: in the above described patents. However, the problem was solved by the present invention because the adjustability of the wire spool holders which are not drilled through the rung supports as well as the total collapsibility of the ladder with the wire caddy still attached.

Innovations within the prior art are rapidly being exploited to hold spools of wire.

The present invention went contrary to the teaching of the art which described externally mounted wire spool holders and wire spool holders which were drilled through the support rungs.

The present invention solved a long felt need of adapting a common ladder with a fully collapsible wire caddy without weakening the strength of the ladder.

The present invention produced unexpected results namely: the steps acted as a wire guide whereby the wire remains untwisted and untangled upon unspooling.

It is the primary object of this invention to provide a wire dispensing device for dispensing coiled wire at an electricians work station.

Another object is the provision of a device for mounting a plurality of wire reels which device is potable and is specifically adapted to be attached generally upright, but not necessarily vertical support rails of an electricians ladder to have the spools readily available for use even though the ladder is moved from place to place.

A related object is the provision of a coiled wire dispenser of the type described which is adapted to be mounted on ladders of different widths and heights.

The present invention pertains to wire spool holding and dispensing apparatus, and, more particularly, to such an apparatus mounted upon a ladder for use in conjunction with the wiring of central telephone offices.

Accordingly, it is the primary object of the present invention to provide a new and novel wire spool holder and dispensing apparatus.

It is another object of the present invention to provide a wire spool holding and dispensing apparatus to permit the dispensing or paying out of wire when desired and for preventing undesired wire rewind after the initial payout thereof.

It is a further object of the present invention to provide an apparatus of the foregoing type which includes a frame adapted to accommodate a plurality of wire spools.

It is still another object of the present invention to provide a wire spool holding and dispensing apparatus of the foregoing type in wherein the frame includes means for maintaining the end of the wire of a reel at a predetermined position with respect to the spool upon which the wire reel is wound.

It is yet a further object of the present invention to provide an apparatus of the foregoing type in conjunction with a ladder whereby a workman on the ladder may perform continuous wiring applications without requiring him to ascend and descend the ladder and without fumbling for the ends of the required wire on the spools.

It is still another object of the present invention to provide an apparatus of the foregoing type which is highly reliable, has simplicity of construction and which is economical to manufacture.

Accordingly, it is an object of the present invention to provide a wire caddy which can collapse concurrently when a ladder collapses to facilitate transportation and storage.

The novel features which are considered characteristic for the invention are set forth in the appended claims. The invention itself, however, both as to its construction and its method of operation, together with additional objects and advantages thereof, will be best understood from the following description of the specific embodiments when read and understood in connection with the accompanying drawings.

DETAILED DESCRIPTION OF THE PREFERRED EMBODIMENT

Figure 1:
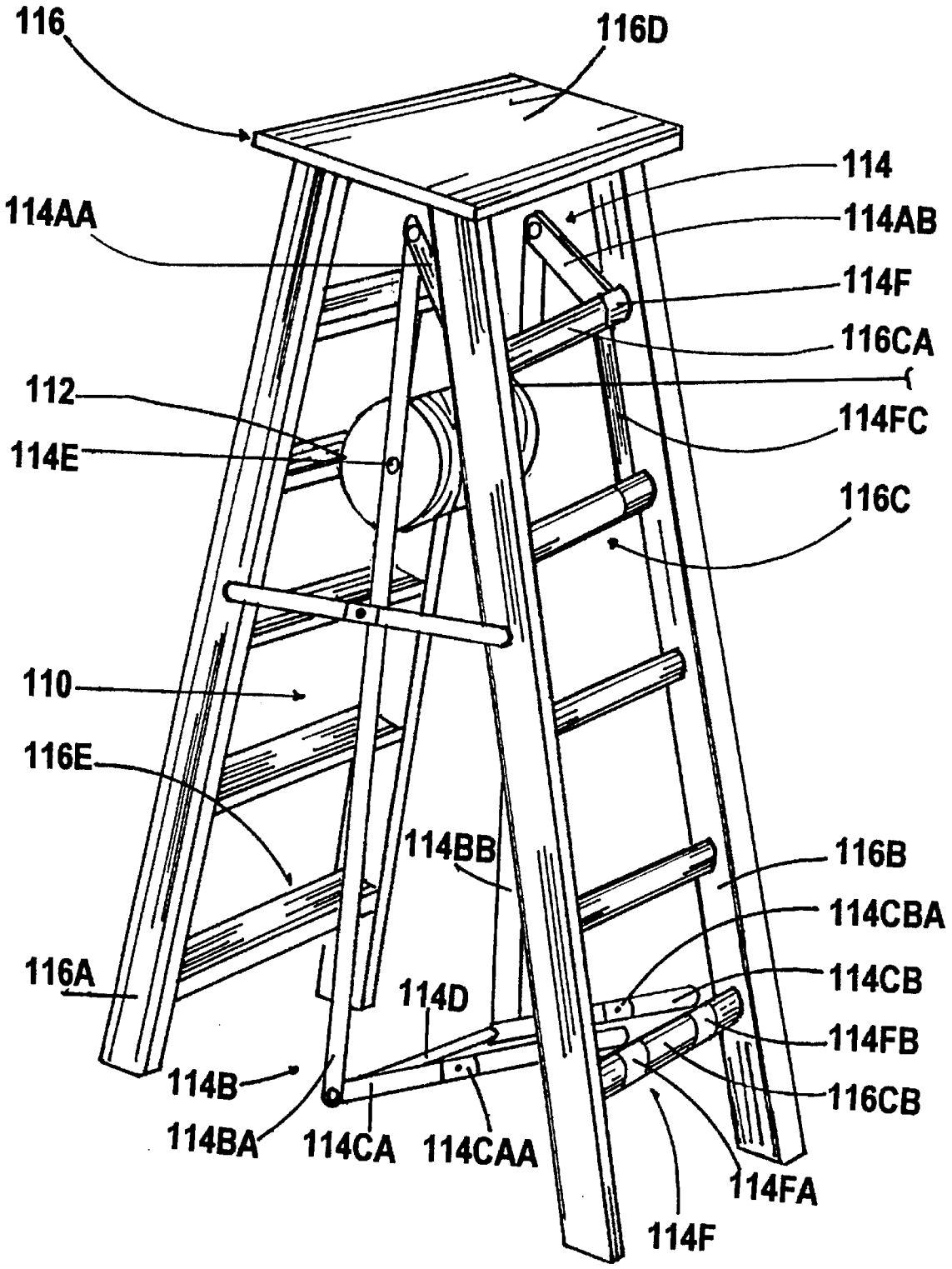
FIG. 1 is a perspective view of a standard ladder in a fully opened position having the first wire caddy attached thereto.
Figure 3:
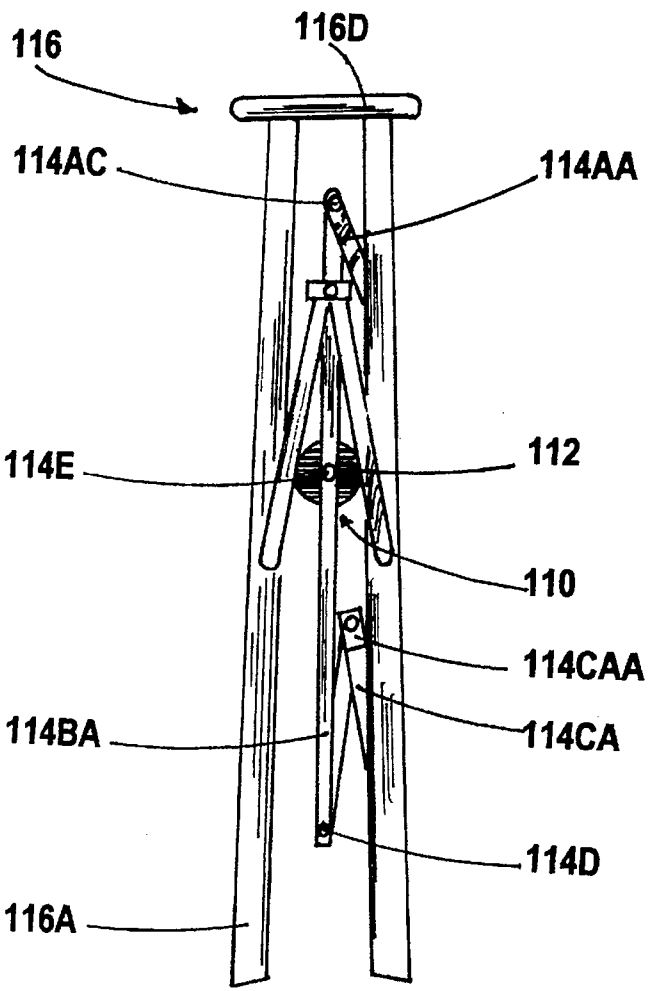
FIG. 3 is a side view of a standard ladder in a fully collapsed position having the first wire caddy attached thereto.
Figure 2:
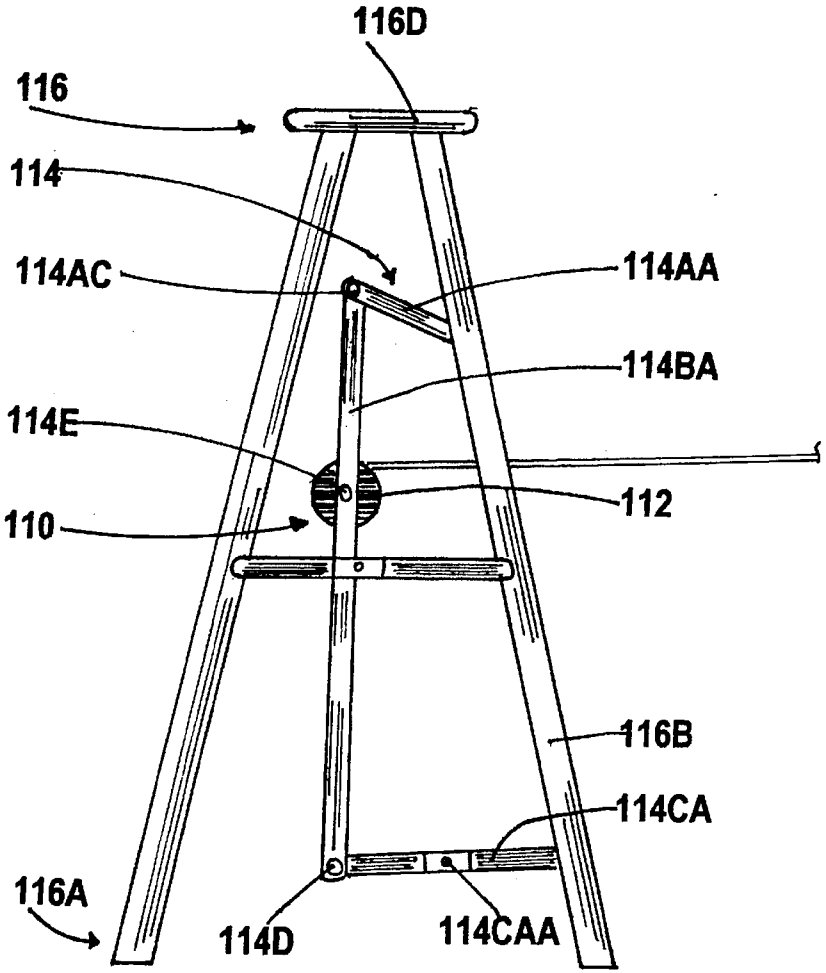
FIG. 2 is a side view of a standard ladder in a fully opened position having the first wire caddy attached thereto.

Firstly referring to FIGS. 1, 2 and 3 which are a perspective view, side view fully opened and side view fully collapsed, respectively, of a first ladder 116 being a standard ladder in a fully opened position having the first wire caddy 110 attached thereto. The first ladder 116 comprises: a pair of first ladder step supports 116A which securely hold a plurality of first ladder steps 116E in place and a pair of first ladder rung supports 116B which function to hold a plurality of first ladder rungs 116C in place. Securely fastened upon the first ladder rang top member 116CA are a first wire spool holder left top rung support 114FC and a first wire spool holder right top rung support 114FD (See FIG. 1). Rotatably fastened upon the first ladder rung bottom member 116CB are a first wire spool holder left bottom rung support 114FA and a first wire spool holder right bottom rung support 114FB. A first ladder top 116D is attached at a top to the pair of first ladder step supports 116A and the pair of first ladder rung supports 116B. The first ladder 116 having a standard hinge closing mechanism, allowing the first ladder 116 to fully collapse.

Securely fastened to the first wire spool holder left top rung support 114FC and a first wire spool holder right top rung support 114FD are the first wire spool holder top left member 114AA and the first wire spool holder top right member 114AB. The first wire spool holder left top rung support 114FC and a first wire spool holder right top rung support 114FD are rotatably fastened onto the first ladder rung top member 116CA such that when the first ladder 116 is collapsed, the first wire spool holder left top rung support 114FC and a first wire spool holder right top rung support 114FD rotate in an upward direction to facilitate concurrent collapsing of the first wire caddy 110.

The first ladder 116 is collapsed, the first wire spool holder left top rung support 114FC are rotatably attached, by a pair of first wire spool holder top member fasteners 114AC, to a first wire spool holder middle member 114B which comprises a first wire spool holder left middle member 114BA and a first wire spool holder right middle member 114BB. When the first wire caddy 110 is in a collapsing position; the first wire spool holder left middle member 114BA and a first wire spool holder right middle member 114BB move in an upward direction and concurrently push the first wire spool holder top left member 114AA and the first wire spool holder top right member 114AB in an upward direction. Spanning between the first wire spool holder left middle member 114BA and a first wire spool holder right middle member 114BB is at least one first wire spool holder top cross member 114E which is securely fastened thereon. The first wire spool holder top cross member 114E is usually manufactured from a round pipe-like material to allow the first wire spool 112 to rotate thereon.

Rotatably affixed upon the first wire spool holder left middle member 114BA and a first wire spool holder right middle member 114BB are a first wire spool holder left bottom member 114CA and a first wire spool holder right bottom member 114CB. At opposite distal ends, the first wire spool holder bottom cross member 114D is securely rotatably fastened to both the first wire spool holder left middle member 114BA and the first wire spool holder left bottom member 114CA on one distal end and to the first wire spool holder right middle member 114BB and the first wire spool holder right bottom member 114CB at the other distal end. When the first wire caddy 110 is in a collapsing position the first wire spool holder left bottom member 114CA and the first wire spool holder right bottom member 114CB collapse by virtue of a first wire spool holder left bottom member hinge 114CAA and a first wire spool holder right bottom member hinge 114CBA in an inward direction and concurrently the first wire spool holder left middle member 114BA and a first wire spool holder right middle member 114BB also move in an upward direction.

Figure 4:
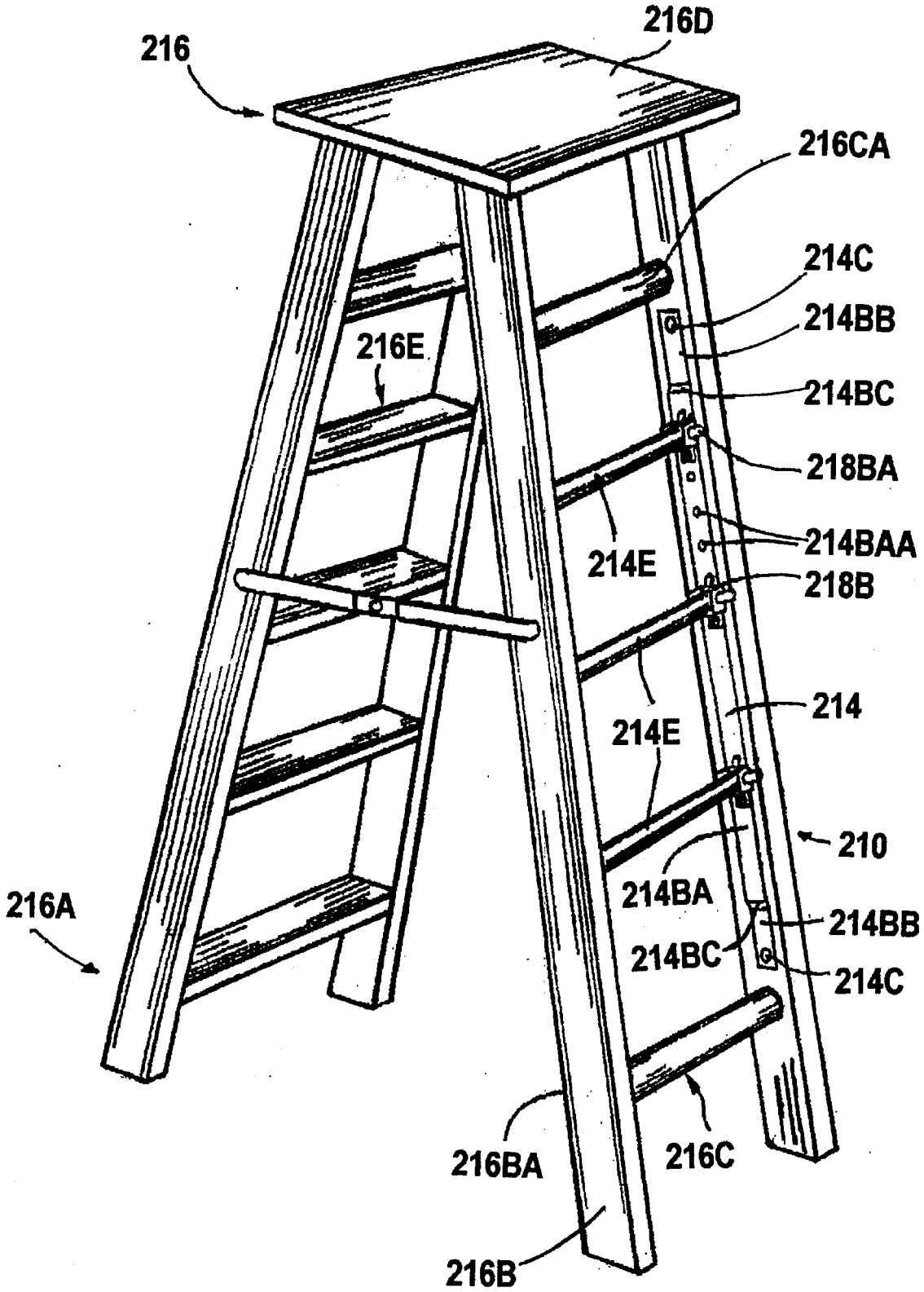
FIG. 4 is a perspective view of a second ladder in a fully opened position having the second wire caddy attached thereto.

Referring now to FIG. 4 which is a perspective view of a second ladder 216 in a fully opened position having the second wire caddy 210 attached thereto. The second ladder 216 can be a standard ladder with the middle rungs removed with a second wire spool holder left track member 214A and a second wire spool holder right track member 214B attached in their place. Spanning across between the second wire spool holder left track member 214A and a second wire spool holder right track member 214B are at least one second wire spool holder cross member 214E which are securely adjustably fastened at each distal end to the second wire spool holder left track member 214A and a second wire spool holder right track member 214B. Upon the second wire spool holder cross member 214E is positioned a second wire spool 212 which is able to then rotate freely. Since the second wire spool holder cross members 214E are adjustably mounted at each distal end on the the second wire spool holder left track member 214A and a second wire spool holder right track member 214B, accommodation for different size second wire spools 212 can easily be made.

Figure 5:
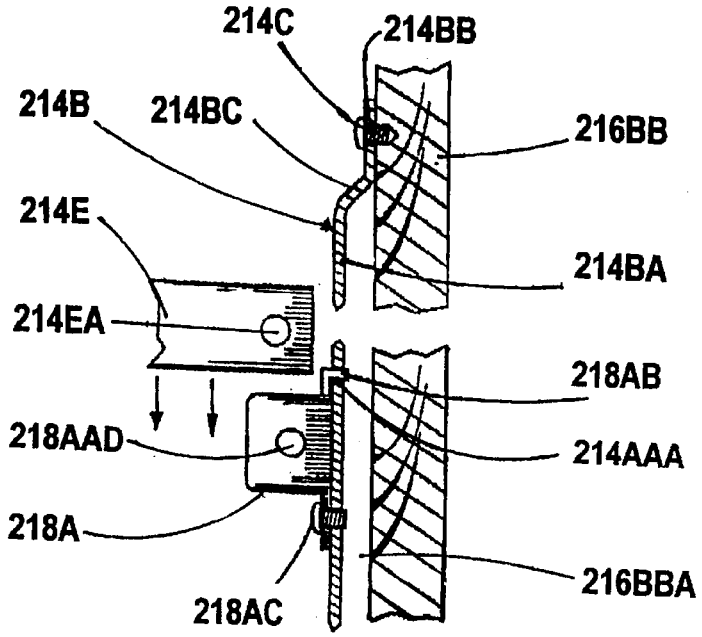
FIG. 5 is a side enlarged view of a second ladder rang right support with the second wire spool holder right track middle member attached thereto. The second wire spool holder right track middle member having second cross member right holder fastened thereon.

Now referring to FIG. 5 which is a side enlarged view of a second ladder rung right support 216BB with the second wire spool holder right track middle member 214BA attached thereto. The second wire spool holder cross members 214E have second wire spool holder cross member left opening 214EA and have second wire spool holder cross member right opening 214EB which correspond to second cross member left holder opening 218AAD and second cross member right holder opening 218BAD, respectively. Through corresponding second wire spool holder cross member right opening 214EB and second cross member right holder opening 218BAD in FIG. 8, a second cross member right holder pin 218BA goes through to securely hold the second cross member 214E in place. Concurrently, through corresponding second wire spool holder cross member left opening 214EA and second cross member left holder opening 218AAD (NOT SHOWN), a second cross member left holder pin 218AA (NOT SHOWN) goes through to securely hold the second cross member 214E in place.

The second wire spool holder right track 214B comprises: a pair of second wire spool holder right track end members 214BB positioned at opposite distal ends which are securely affixed to the second ladder rung right support 216BB by the second wire spool holder track fastener 214C, a pair of second wire spool holder right track angular members 214BC positioned at opposite distal ends between the second wire spool holder right track end members 214BB and the second wire spool holder right track middle member 214BA. Due to the second wire spool holder right track angular members 214BC at each distal end, the second wire spool holder right track middle member 214BA is raised away from the second ladder rung support 216B forming a second ladder rung right space 216BBA which facilitates adjustable movement of the second cross member right holder 218B. The second cross member right holder 218B further comprises a second cross member right holder peg 218BB securely affixed thereto. The second cross member right holder peg 218BB goes in one of the plurality of second wire spool holder right track middle member openings 214BAA positioned at the top of the second cross member right holder 218B. The second cross member right holder 218B further comprises a second cross member right holder fastener 218BC which is securely affixed into one of the plurality of second wire spool holder right track middle member openings 214BAA which is positioned below the second cross member right holder 218B. The plurality of second wire spool holder right track middle member openings 214BAA allows for adjustability of the second cross member 214E.

A similar system (NOT SHOWN) is positioned on the second ladder rung left support 216BA comprising: The second wire spool holder left track 214A comprises: a pair of second wire spool holder left track end members 214AB positioned at opposite distal ends which are securely affixed to the second ladder rung left support 216AB by the second wire spool holder track fastener 214C, a pair of second wire spool holder left track angular members 214AC positioned at opposite distal ends between the second wire spool holder left track end members 214AB and the second wire spool holder left track middle member 214AA. Due to the second wire spool holder left track angular members 214AC at each distal end, the second wire spool holder left track middle member 214AA is raised away from the second ladder rung support 216B forming a second ladder rung left space 216ABA which facilitates adjustable movement of the second cross member left holder 218A. The second cross member left holder 218A further comprises a second cross member left holder peg 218AB securely affixed thereto. The second cross member left holder peg 218AB goes in one of the plurality of second wire spool holder left track middle member openings 214AAA positioned at the top of the second cross member left holder 218A. The second cross member left holder 218A further comprises a second cross member left holder fastener 218AC which is securely affixed into one of the plurality of second wire spool holder left track middle member openings 214AAA which is positioned below the second cross member left holder 218A. The plurality of second wire spool holder left track middle member openings 214AAA allows for adjustability of the second cross member 214E.

Figure 6:
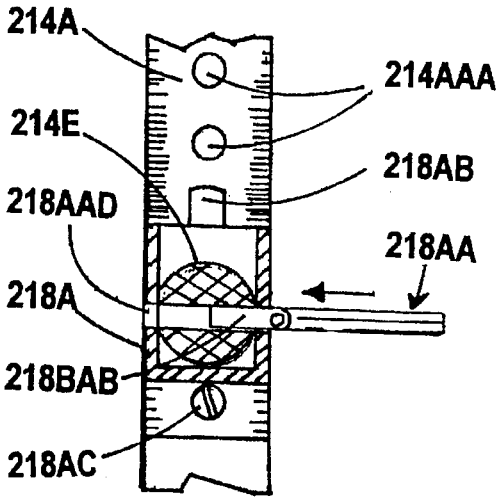
FIG. 6 is a front enlarged view of a second wire spool holder right track middle member with a second cross member right holder attached thereon. The second cross member right holder having a second cross member right holder pin being inserted therein.

Referring now to FIG. 6 which is a from enlarged view of a second wire spool holder right track middle member 214BA with a second cross member right holder 218B (See FIG. 6) attached thereon. The second wire spool holder right track middle member 214BA having second cross member right holder 218B fastened thereon. The second cross member right holder 218B having a second cross member right holder pin 218BA being inserted therein. The second cross member right holder pin 218BA comprises: a second cross member right holder pin shaft 218BAA moveably attached to a second cross member right holder pin lock 218BAB by a second cross member right holder pin swivel 218BAC.

Notice how the second cross member right holder peg 218BB is affixed into one of the second wire spool holder right track middle member openings 214BAA at a top of the second cross member right holder 218B and the second cross member right holder fastener 218BC is affixed to one of the second wire spool holder right track middle member openings 214BAA at the bottom of the second cross member right holder 218B. Both the second wire spool holder cross member right opening 214EB and the second cross member right holder opening 214BAD are in alignment with each other thereby permitting the second cross member right holder pin 218BA to be inserted therein.

Figure 7:
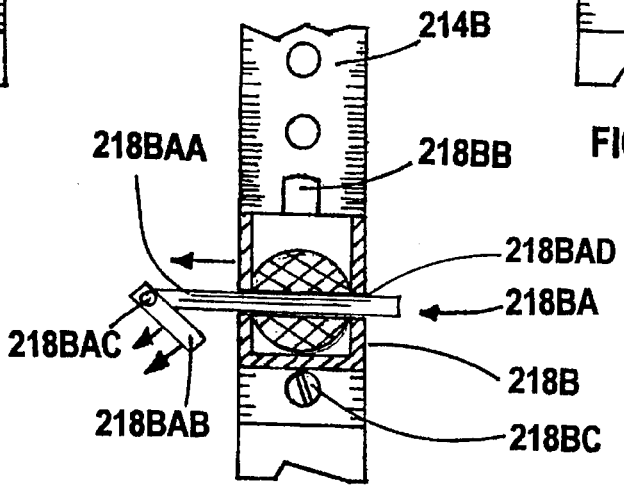
FIG. 7 is a front enlarged view of a second wire spool holder right track middle member with a second cross member right holder attached thereon. The second cross member right holder having a second cross member right holder pin having a second cross member right holder pin lock being moved into a locking position.

Referring to FIG. 7 which is a front enlarged view of a second wire spool holder right track middle member 218BA with a second cross member right holder 218B attached thereon. The second cross member right holder having a second cross member right holder pin 218BA having a second cross member right holder pin lock 218BAB being moved into a locking position.

Figure 8:
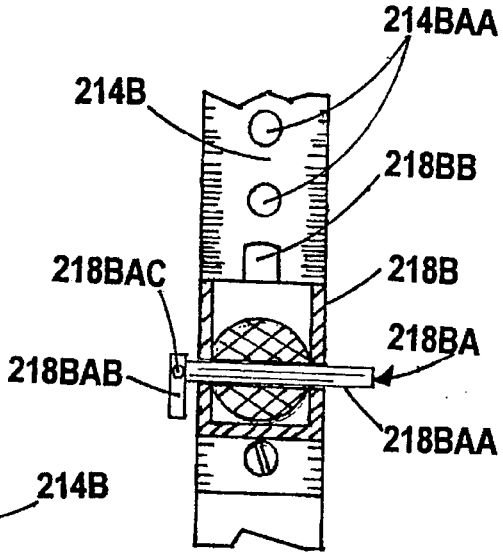
FIG. 8 is a front enlarged view of a second wire spool holder right track middle member with a second cross member right holder attached thereon. The second cross member right holder having a second cross member right holder pin having a second cross member right holder pin lock being moved into a locked position.

Referring to FIG. 8 which is a front enlarged view of a second wire spool holder right track middle member 214BA with a second cross member right holder 218B attached thereon. The second cross member right holder 218B having a second cross member right holder pin 218BA having a second cross member right holder pin lock 218BAB being moved into a downward locked position.

Figure 9:
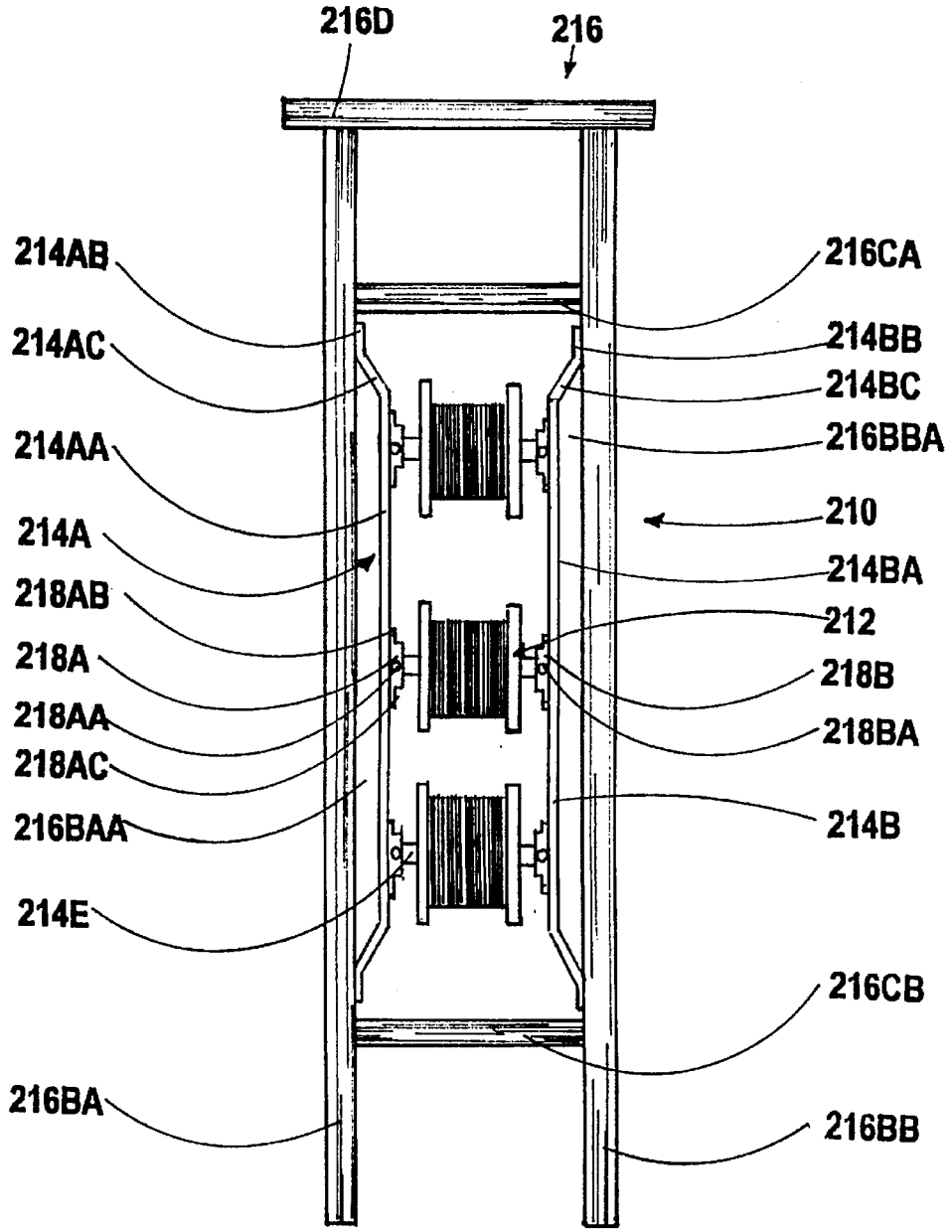
FIG. 9 is a front view of a second ladder in a fully opened position having the second wire caddy and wire spools attached thereto.

Referring now to FIG. 9 which is a front view of a second ladder 216 in a fully opened position having the second wire caddy 210 attached thereto. The second ladder 216 can be a standard ladder with the middle rungs removed with a second wire spool holder left track member 214A and a second wire spool holder right track member 214B attached in their place. Spanning across between the second wire spool holder left track member 214A and a second wire spool holder right track member 214B are at least one second wire spool holder cross member 214E with second wire spools 212 attached thereon further having which are securely adjustably fastened at each distal end to the second wire spool holder left track member 214A and a second wire spool holder right track member 214B. Upon the second wire spool holder cross member 214E is positioned through a second wire spool 212 which is able to then rotate freely. Since the second wire spool holder cross members 214E are adjustably mounted at each distal end on the the second wire spool holder left track member 214A and a second wire spool holder right track member 214B, accommodation for different size second wire spools 212 can easily be made.

Figure 10:
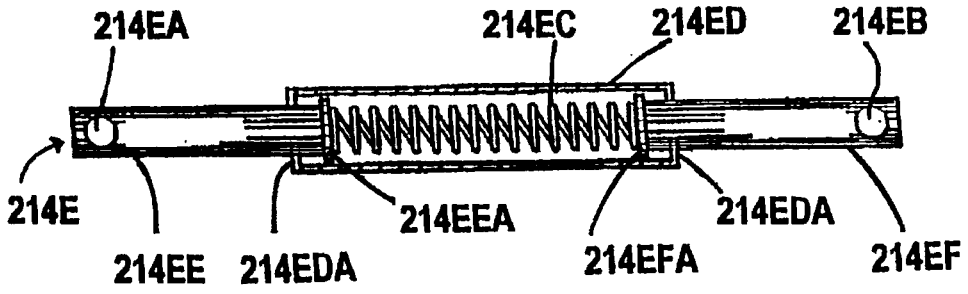
FIG. 10 is a cross sectional side view of the second wire spool holder cross member exhibiting a internally located second wire spool holder cross member spring which pushes outwardly a second wire spool holder cross member left plunger by a second wire spool holder cross member left plunger spring retainer and a second wire spool holder cross member right plunger by a second wire spool holder cross member right plunger spring retainer.

Lastly, referring to FIG. 10 which is a cross sectional side view of a second wire spool holder cross member 214E exhibiting a internally located second wire spool holder cross member spring 214EC which pushes outwardly a second wire spool holder cross member left plunger 214EE by a second wire spool holder cross member left plunger spring retainer 214EEA and second wire spool holder cross member right plunger 214EF by a second wire spool holder cross member right plunger spring retainer 214EFA. The second wire spool holder cross member spring 214EC, the second wire spool holder cross member left plunger 214EE, the second wire spool holder cross member left plunger spring retainer 214EEA, the second wire spool holder cross member right plunger 214EF, and the second wire spool holder cross member right plunger spring retainer 214EFA are enclosed within a second wire spool holder cross member cylinder 214ED. The second wire spool holder cross member cylinder 214ED having a opening at each distal end to slidably accomodate the second wire spool holder cross member left plunger 214EE and the second wire spool holder cross member right plunger 214EF with respective second wire spool holder cross member cylinder lips 214EDA at each distal end of the second wire spool holder cross member cylinder 214ED functioning as a stopping point whereby the second wire spool holder cross member left plunger spring retainer 214EEA and the second wire spool holder cross member right plunger spring retainer 214EFA are stopped in an extended position when the second wire spool holder cross member spring 214EC is fully elongated. The second wire spool holder cross member 214E further comprises a second wire spool holder cross member left opening 214EA and a second wire spool holder cross member right opening 214EB at opposite distal ends through which the second cross member left holder pin 218AA and the second cross member right holder pin 218BA are fastened therethrough. The second wire spool holder cross member 214E functions to accomodate different width ladders as well as ladders with varying widths from top to bottom.

It will be understood that each of the elements described above, or two or more together, may also find a useful application in other types of constructions differing from the type described above.

While the invention has been illustrated and described as embodied in a WIRE CADDY ATTACHABLE TO A LADDER, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. A combination wire caddy and ladder structure comprising:

A) a ladder (116) which comprises at least two ladder step supports (116A) having at least one ladder step (116E) therebetween, at least two ladder rung supports (116B) having fixedly attached therebetween at least one ladder rung top member (116CA) and at least one ladder rung bottom member (116CB), a ladder top (116D) securely fastened at the top distal end of the at least two ladder step supports (116A) and further securely fastened at the top distal end of the at least two ladder rung supports (116B); and B) a wire spool holder (114) upon which a wire spool (112) is rotatably mounted, the wire spool holder (114) comprises:

i) a wire spool holder top member consisting of a wire spool holder top left member (114AA) and a wire spool holder top right member (114AB), ii) a wire spool holder middle member (114B) consisting of a wire spool holder left middle member (114BA) and a wire spool holder right middle member (114BB), the wire spool holder left middle member (114BA) and the wire spool holder top left member (114AA) rotatably fastened at distal ends to each other by a wire spool holder top member fastener (114AC), the wire spool holder right middle member (114BB) and the wire spool holder top right member (114AB) rotatably fastened at distal ends to each other by a wire spool holder top member fastener 114AC, iii) a wire spool holder bottom member consisting of a wire spool holder left bottom member (114CA) and a wire spool holder right bottom member (114CB), the wire spool holder left bottom member (114CA) rotatably attached to the wire spool holder left middle member (114BA) and concurrently, the wire spool holder right bottom member (114CB) rotatable attached to the wire spool holder right middle member (114BB), iv) a wire spool holder bottom cross member (114D) fixedly attached at one distal end to the wire spool holder left middle member (114BA) and at a second distal end to wire spool holder right middle member (114BB), v) at least one wire spool holder top cross member (114E) removably mountedly at one distal end to the wire spool holder left middle member (114BA) and at a second distal end to the wire spool holder right middle member (114BB), a wire spool (112) rotatably mounted upon the wire spool holder top cross member (114E), vi) a wire spool holder rung support (114F) consisting of a wire spool holder left bottom rung support (114FA), a wire spool holder right bottom rung support (114FB), a wire spool holder left top rung support (114FC), and a wire spool holder right top rung support, the wire spool holder left bottom rung support (114FA) movably mounted at to the first ladder rung bottom member (116CB) and securely affixed to the wire spool holder left bottom member (114CA), the wire spool holder right bottom rung support (114FB) securely affixed to the wire spool holder right bottom member (114CB), the wire spool holder left top rung support (114FC) securely affixed to the wire spool holder left top member (114AA), and the wire spool holder right top rung support securely affixed to the wire spool holder right top member (114AB).

2. The combination wire caddy and ladder structure as described in claim 1, wherein the wire spool holder right bottom member (114CB) and the wire spool holder left bottom member (114CA) further comprise a wire spool holder right bottom member hinge (114CBA) and a wire spool holder left bottom member hinge (114CAA), respectively which function to further collapse the members.

3. A combination wire caddy and ladder structure (210) comprising:

A) a ladder (216) which comprises at least two ladder step supports (216A), ladder (216) further comprises at least two ladder rung supports (216B) having a ladder rung left support 216BA and a ladder rung right support (216BB), ladder top (216D) securely affixed at a top distal end of the at least two ladder step supports (216A) and securely affixed at a top distal end to the at least two ladder rung supports (216B); and B) a wire spool holder (214) consisting of:

i) a wire spool holder left track member (214A) further consisting of a wire spool holder left track middle member (214AA) further having a pair of wire spool holder left track end members (214AB) positioned at opposite distal ends of the wire spool holder left track middle member (214AA) and still further having a pair of wire spool holder left track angular members (214AC) positioned at opposite distal ends of the wire spool holder left track middle member (214AA) between the wire spool holder left track end members (214AB) and the wire spool holder left track middle member (214AA), the wire spool holder left track angular members (214AC) functioning to form a ladder rung left space (216BAA) between the wire spool holder left track middle member (214AA) and the ladder rung left support (216BA), the wire spool holder left track middle member (214AA) further comprises a plurality of wire spool holder left track middle member openings (214AAA) therein, a pair of wire spool holder track fasteners (214C) function to attach each of the wire spool holder left track end members (214AB) to the ladder rung left support (216BA), ii) a wire spool holder right track member (214B) further consisting of a wire spool holder right track middle member (214BA) further having a pair of wire spool holder right track end members (214BB) positioned at opposite distal ends of the wire spool holder right track middle member (214BA) and still further having a pair of wire spool holder track angular members (214BC) positioned at opposite distal ends of the wire spool holder right track middle member between the wire spool holder right track end members (214BB) and the wire spool holder right track middle member (214BA), the wire spool holder right track angular members (214BC) functioning to form a ladder rung right space (216BBA) between the wire spool holder right track middle member (214BA) and the ladder rung right support (216BB), the wire spool holder right track middle member (214BA) further comprises a plurality of wire spool holder right track middle member openings (214BAA) therein, a pair of wire spool holder track fasteners (214C) function to attach each of the wire spool holder right track end members (214BB) to the ladder rung right support (216BB), iii) at least one wire spool holder cross member (214E) having wire spool holder cross member left opening (214EA) and wire spool holder cross member right opening (214EB) each positioned at opposite distal ends of the at least one wire spool holder cross member (214E), iv) a cross member holder comprises at least one cross member left holder (218A) and at least one cross member right holder (218B), the at least one cross member left holder (218A) having a cross member left holder peg (218AB) and a cross member left holder fastener (218AC) securely affixed onto the cross member left holder (218A) the cross member left holder peg (218AB) and the cross member left holder fastener (218AC) integrally mounted within two of the wire spool holder left track middle member openings (214AAA) functioning to adjustably and securely affix the cross member left holder (218A) to the wire spool holder left track middle member (214AA), and at least one cross member left holder (218A) further having a cross member left holder opening (218AAD) therein through which a cross member left holder pin (218AA) securely affixes at least one cross member left holder (218A) to the at least one wire spool holder cross member (214E) through the wire spool holder cross member left opening (214EA), and at least one cross member right holder (218B) having a cross member right holder peg (218BB) and a cross member right holder fastener (218BC) securely affixed onto the cross member right holder (218B), the cross member right holder peg (218BB) and the a cross member right holder fastener (218BC) integrally mounted within two of the wire spool holder right track middle member openings (214BAA) functioning to adjustably and securely affix the cross member right holder (218B) to the wire spool holder right track middle member (214BA), and at least one cross member right holder (218A) further having a cross member right holder opening (218BAD) therein through which a cross member right holder pin (218BA) securely affixes the at least one cross member right holder (218A) to at least one wire spool holder cross member (214E) through the wire spool holder cross member right opening (214EB).

4. The combination wire caddy and ladder structure (210) as described in claim 3, wherein the cross member right holder pin (218BA) further comprises a cross member right holder pin shaft (218BAA) adjustably mounted on a cross member right holder pin lock (218BAB) by a cross member right holder pin swivel (218BAC).

5. The combination wire caddy and ladder structure (210) as described in claim 3, wherein the cross member left holder pin (218AA) further comprises a cross member left holder pin shaft adjustably mounted on a cross member left holder peg by a cross member left holder fastener.

6. The combination wire caddy and ladder structure (210) as described in claim 3, wherein the ladder further comprises at least one ladder rung (216C).

7. The combination wire caddy and ladder structure (210) as described in claim 6, wherein the ladder further comprises at least one ladder rung top member (216CA) and at least one ladder rung bottom member (216CB).

8. The combination wire caddy and ladder structure (210) as described in claim 3, wherein the wire spool holder cross member (214E) is expandable.

9. The combination wire caddy and ladder structure (210) as described in claim 8, wherein the wire spool holder cross member (214E) further comprises a wire spool holder cross member left plunger (214EE) having a wire spool holder cross member left plunger spring retainer (214EEA) positioned at an inner distal end, a wire spool holder cross member right plunger (214EF) having a wire spool holder cross member right plunger spring retainer (214EFA) positioned at an inner distal end and a wire spool holder cross member cylinder (214ED) having a wire spool holder cross member cylinder lip (214EDA) positioned at opposite distal ends of the wire spool holder cross member cylinder (214ED), the wire spool holder cross member left plunger spring retainer (214EEA) and the wire spool holder cross member right plunger spring retainer (214EFA) having an expandable wire spool holder cross member spring (214EC) therebetween.

* * * * *